US005083754A

United States Patent [19]

Russo

[11] Patent Number: 5,083,754

[45] Date of Patent: Jan. 28, 1992

[54] APPARATUS FOR RETAINING SLAG DURING THE DISCHARGE OF MOLTEN METAL FROM A TUNDISH

[75] Inventor: Thomas J. Russo, Kingsville, Md.

[73] Assignee: Bethlehem Steel Corporation, Bethlehem, Pa.

[21] Appl. No.: 717,963

[22] Filed: Jun. 20, 1991

[51] Int. Cl.[5] ..... B22D 41/14

[52] U.S. Cl. ..... 266/230; 266/227

[58] Field of Search ..... 266/227, 230, 45, 231; 222/591, 594, 597

[56] References Cited

U.S. PATENT DOCUMENTS 3,934,755 1/1976 Rheinlander et al. ..... 266/230
4,526,349 7/1985 Schwer ..... 266/227
4,573,664 3/1986 Prendergast ..... 266/230

FOREIGN PATENT DOCUMENTS 3235420 9/1988 Japan ..... 266/230

*Primary Examiner*—S. Kastler
*Attorney, Agent, or Firm*—John I. Iverson

[57] ABSTRACT

Apparatus for retaining slag in a tundish or a ladle or similar vessel containing molten metal such as used in the steel industry. A refractory nozzle member and a refractory retainer member are secured to the bottom of the vessel around the molten metal discharge orifice. A refractory plug member of a density between that of the molten metal and the slag is positioned laterally within the retainer member but free to move vertically during discharge of the molten metal from the vessel.

10 Claims, 2 Drawing Sheets

APPARATUS FOR RETAINING SLAG DURING THE DISCHARGE OF MOLTEN METAL FROM A TUNDISH

BACKGROUND OF THE INVENTION

This invention relates to apparatus for minimizing the carryover of slag during the draining of molten metal from a tundish, ladle or other vessel. It relates particularly to a method of preventing a significant carryover of slag when molten steel is discharged from a tundish into the mold of a continuous casting machine.

When molten steel has been suitably refined in a furnace and is ready to be cast, the molten steel is tapped or poured into a refractory lined steel transfer ladle. The molten steel often then has further treatment, such as desulfurization, while in the ladle before the ladle is taken to a refractory lined tundish which feeds the molten metal into the mold of a continuous casting machine.

When the molten steel is tapped from the refining furnace into the ladle and poured from the ladle into the tundish, a certain amount of slag is carried over with the molten steel into the tundish. In addition, while the molten steel is in the ladle and tundish, slag forming materials are often added to assist in the further treatment of the steel while it is in the ladle and tundish or to act as an insulator.

Since the slag is less dense than the molten steel, any slag will float on the surface of the molten steel contained in the tundish. However, as the steel is drained from the tundish through a discharge orifice in the bottom of the tundish, some slag will often carryover into the mold of the continuous casting machine unless the operator is very careful. Slag in the mold of a continuous casting machine results in a poor quality cast steel product. As a result, it is common for operators to leave a substantial amount of good steel in the tundish to avoid any slag carryover into the caster mold. This practice is wasteful, expensive and results in a poor yield to the steelmaker.

In recent years a number of fabricated plugs or stoppers of a density between that of the molten steel and the slag have been developed and patented to prevent slag carryover. These fabricated plugs and stoppers are designed to float freely at the slag-molten metal interface in the vicinity of the discharge orifice in the bottom of the ladle or tundish and are designed to be drawn into the orifice to prevent the entry of slag as the level of molten metal in the ladle or tundish drops. The following U.S. Pat. Nos. describe the various shapes and configurations for these fabricated plugs or stoppers.

| | | | | |
|---|---|---|---|---|
| U.S. Pat. No. | 2,246,144 | Perrin | 1941 | Raft |
| | 2,718,389 | Perrin | 1955 | Dam |
| | 4,462,574 | Keenan | 1984 | Cube |
| | 4,494,734 | LaBate | 1985 | Rod Stopper |
| | 4,526,349 | Schwer | 1985 | Disc |
| | 4,601,415 | Koffron | 1986 | Tapered Polygon |
| | 4,610,436 | LaBate | 1986 | Rod Stopper |
| | 4,709,903 | LaBate | 1987 | Rod Stopper |
| | 4,725,045 | Cutre | 1988 | Cone |
| | 4,799,650 | LaBate | 1989 | Rod Stopper |
| | 4,922,994 | Ogura | 1990 | Sphere |

These fabricated plugs or stoppers require a precise placement of the device right over the drain orifice to be effective. Most require an elaborate boom or mechanical arm to reach into the ladle or tundish towards the end of the pour to position the plug or stopper right over the discharge orifice. Such devices are frequently not accurately positioned, rendering them ineffective.

SUMMARY OF THE INVENTION

It is an object of this invention to provide apparatus for minimizing slag carryover during the discharge of molten metal from a tundish or other vessel.

It is a further object of this invention to provide apparatus of minimizing slag carryover during the discharge of molten metal from a tundish which apparatus is relatively inexpensive and does not require special placement equipment.

It has been discovered that the foregoing objectives can be attained by a refractory nozzle member secured in the discharge orifice of the tundish or vessel, a refractory plug member having a density between the density of the molten metal and the density of the slag floating on top of the molten metal and a refractory retainer member secured to the bottom of the tundish or vessel which surrounds the nozzle member and the plug member whereby the plug member is retained substantially in alignment with the discharge orifice during the discharge of the molten metal from the tundish or vessel.

DESCRIPTION OF THE PREFERRED EMBODIMENT

Figure 1:
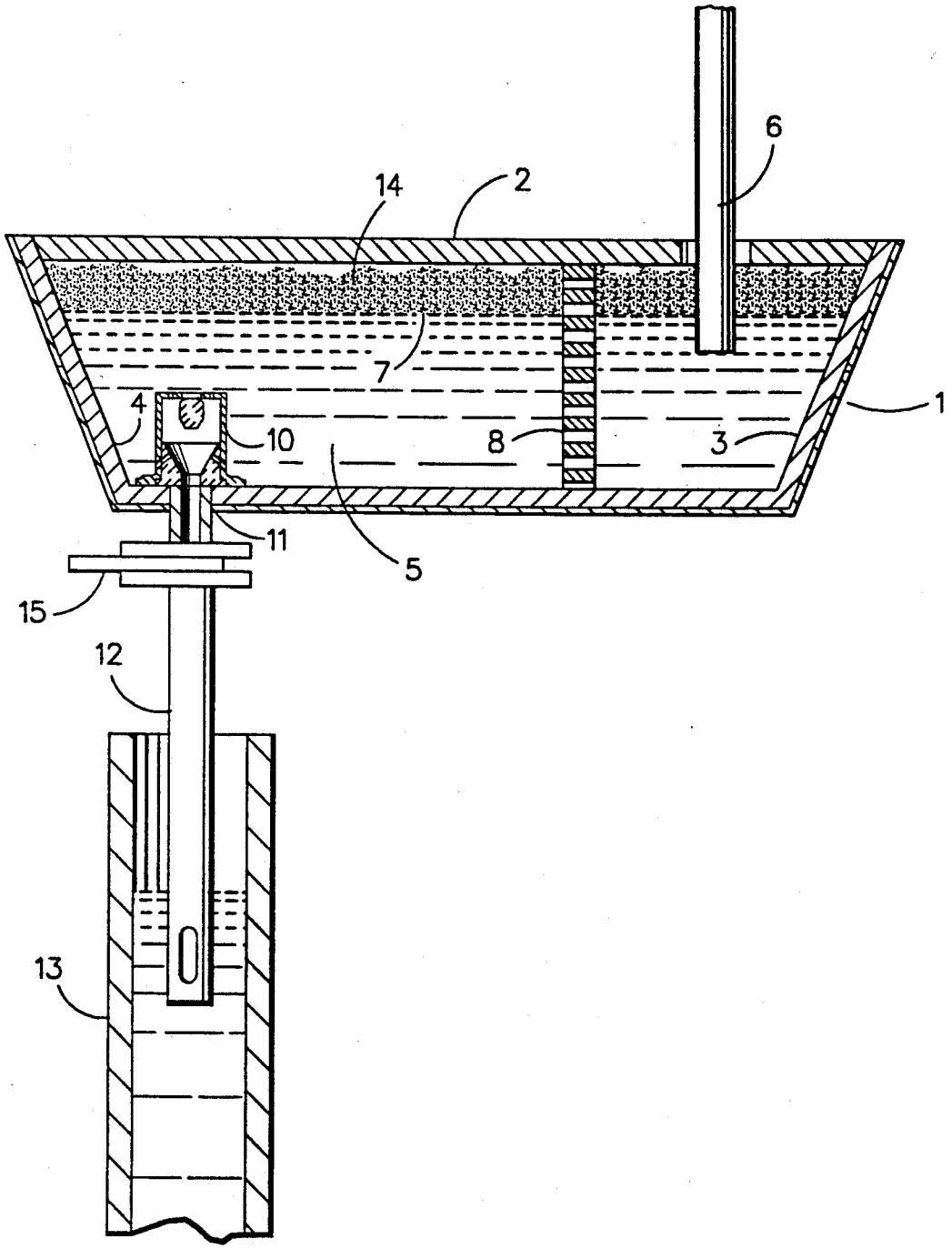
FIG. 1 is a cross-section of a tundish of molten steel illustrating the apparatus of this invention.
Figure 3:
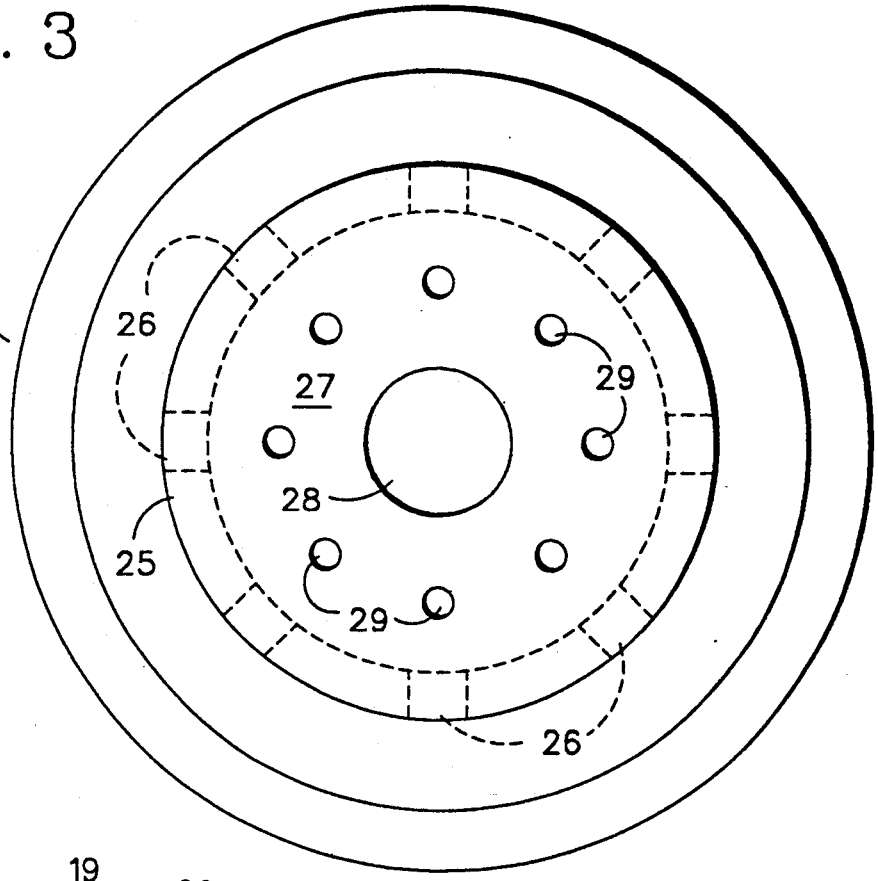
FIG. 3 is a top view of the apparatus of this invention.
Figure 2:
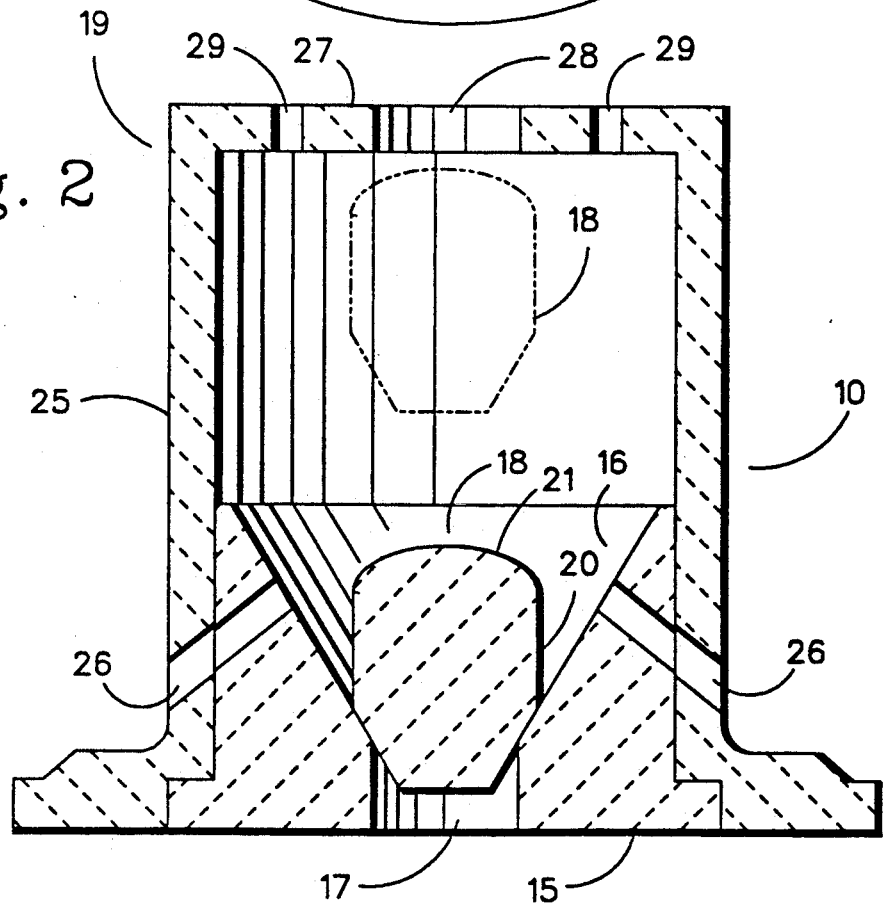
FIG. 2 is a schematic cross-section of the apparatus of this invention.

A preferred embodiment of the apparatus of this invention is illustrated in FIGS. 1–3. FIG. 1 illustrates a conventional four-sided refractory lined tundish 1 having a removable cover 2. The tundish 1 has a sloping entry end wall 3, a sloping discharge end wall 4 and a pair of sloping sidewalls 5.

A ladle (not shown) positioned above the tundish 1 supplies molten metal to the tundish 1 through a submerged refractory entry tube 6. The level of the molten metal, shown by line 7 is maintained substantially constant after the tundish 1 is filled. The molten metal in the tundish 1 flows slowly from the entry end of the tundish 1 past a refractory baffle or baffles 8 towards the discharge end of the tundish 1. Baffles 8 are designed to produce a uniform flow of molten metal from the entry end to the discharge end of the tundish 1 with a minimum amount of turbulence or eddies.

The apparatus of this invention, shown generally at 10 in FIG. 1, is secured to the refractory lining of tundish 1 around the discharge orifice 11 in the bottom of tundish 1 and will be described in more detail below. The molten metal in tundish 1 flows through the apparatus of this invention 10 into a sealed refractory tube 12 having a gate valve 15 and into the open top of a continuous casting mold 13.

As shown in FIG. 1, floating on top of the surface 7 of molten metal in tundish 1 is usually a layer of slag 14 which being of less density than that of the molten metal will remain on the surface 7 of molten metal in the tundish 1 during casting operations. This slag 14 is a result of slag being carried over into the tundish 1 from the ladle or a result of special slags added to the tundish 1 to further define or purify the molten metal while in the tundish 1, or both.

FIGS. 2 and 3 illustrate the apparatus of this invention 10 which can also be considered a slag valve in the discharge orifice 11 of the tundish 1. The slag valve 10 is comprised of three pieces, a refractory nozzle member 15 secured to the refractory lining of tundish 1 in the discharge orifice 11, a refractory plug member 18 and a refractory retainer number 19.

As shown in FIG. 2, the refractory nozzle member 15 has a conical entry portion 16 and a cylindrical discharge portion 17. As also shown in FIG. 2, the refractory plug member 18 is a relatively small refractory section having a conical base 19, cylindrical sidewalls 20 and a spherical top 21 and is slightly larger than the diameter of the cylindrical discharge portion 17 of refractory nozzle member 15. The refractory plug member 18 could be of other shapes, such as a sphere so long as it will fit tightly into the conical entry portion 16 of refractory nozzle member 15. The refractory plug member 18 is made of a refractory material that will not melt or soften at the temperatures of molten steel in the tundish 1 (about 1650° C.) and is of a density between that of molten steel (about 7.8 grams per cubic centimeter) and that of molten slag (about 2.7 grams per cubic centimeter that floats on top of the molten steel in tundish 1. A preferred refractory material for the refractory plug member would be a magnesia chrome refractory having a density of about 3.5 grams per cubic centimeter and a melting point considerably in excess of 1650° C.

FIGS. 2 and 3 illustrate the refractory retainer member 19 which is secured to the bottom of tundish 1 around the discharge orifice 11 and the nozzle member 15 by flanges. Retainer member 19 is generally a hollow refractory shape cast in the form of a cylinder on the frustrum of a cone. The sidewalls 25 of the retainer member 19 are provided with a plurality of molten metal inlets 26. The closed top 27 of the retainer member 19 has a central opening 28 of smaller diameter than the diameter of refractory plug 18 and a plurality of small gas orifices 29.

The operation of the slag valve or apparatus of this invention 19 is quite simple but very effective to prevent the entry of slag for the tundish 1 into the continuous casting mold 13.

As the tundish 1 is filled with molten metal, the refractory plug member 18 being of a density less than that of the molten metal will float upwards to the position shown in dotted outline in FIG. 1 permitting molten metal to flow into molten metal inlets 26 in the retainer member 19 and nozzle member 15 and into nozzle outlet 17. The spherical top 18 of the refractory plug member 18 will be held in the central top opening of retainer member 19 to position the plug member 18 directly above the nozzle member 15 opening directly below. The gas opening 29 in the top of the retainer member 19 allow the nonoxidizing gas (argon) introduced in pouring tube 12 and nozzle 15 to prevent oxidation of the molten metal, to escape from retainer member 19. Central opening 28 also provides means to open up discharge orifice 11 with an oxygen lance or probe in the event of molten metal freeze up in the nozzle member 15.

At the end of the cast, the level of molten metal in tundish 11 is lowered gradually. As the level of molten metal drops below the top 27 of the retainer member 27, the refractory plug member 18 will gradually sink vertically downwardly until it seats tightly in the conical portion 16 of the nozzle member 15 as shown in FIG. 2. Plug member 18 thereby seals the nozzle 15 at the point where slag would begin to enter retainer 19. With this apparatus more molten metal can be discharged from the tundish without fear of introducing slag into the continuous casting mold, thereby increasing yield to the operation.

The apparatus of this invention should improve the quality of the steel being cast since the molten steel must enter the chamber 10 from the bottom of tundish 1 through the inlets 26. Harmful inclusion materials tend to float on the surface of the metal rather than sink to the bottom of the tundish. Also by forcing the steel to enter chamber 10 circumferentially, flow into the nozzle 11 is more evenly distributed and reduces the possibility of plugging.

The apparatus of this invention also allows for greater discharge rates since the nozzle diameter is effectively increased by the circumference of apparatus 10.

A specific example of this invention used a nozzle member 15 having an outside diameter of about 40 centimeters and a discharge opening of about 12.7 centimeters. Plug member 18 had an overall diameter of about 15.2 centimeters and a height of about 21.6 centimeters. The retainer member 19 had an inside diameter of about 40 centimeters, an outside diameter of about 45.7 centimeters and a height of about 54.6 centimeters above the flange. Central opening 28 was about 12.7 centimeters in diameter. The retainer 18 and nozzle 15 had six molten metal inlets 26 of about 5 centimeters in diameter.

While I have described the apparatus of this invention as applied to a tundish, it is contemplated that this invention could be used in any type of vessel that contains molten metal and slag where it is desired to separate the two during the draining of the molten metal from the vessel. The invention would be useful in furnaces, ladles and molten metal treatment vessels.

I claim:

1. Apparatus for preventing the carryover of slag during the discharge of molten metal from a refractory lined vessel having a discharge orifice in the bottom thereof comprising—

(a) a refractory nozzle member secured in said discharge orifice;

(b) a refractory plug member having a density between the density of the molten metal and the density of the slag;

(c) a refractory retainer member secured to the bottom of said refractory lined vessel and surrounding said nozzle member and said plug member whereby said plug is retained substantially in alignment with said discharge orifice during the discharge of the molten metal from said refractory lined vessel.

2. The apparatus of claim 1 in which the refractory nozzle member has a conical entry portion and a cylindrical discharge portion.

3. The apparatus of claim 1 in which a plurality of molten metal passages are provided in the sidewalls of said retainer member and the conceal entry portion of said refractory nozzle member.

4. The apparatus of claim 3 in which the molten metal passages are inclined upwardly relative to the bottom of said refractory lined vessel.

5. The apparatus of claim 1 in which said retainer member has a top portion spaced above the bottom of said refractory lined vessel.

6. The apparatus of claim 5 in which said top portion of said retainer member has a central opening positioned directly above said discharge orifice.

7. The apparatus of claim 6 in which said top portion of said retainer member has a plurality of openings surrounding said central opening.

8. The apparatus of claim 1 in which said refractory nozzle member and said retainer member are secured to each other by interlocking flanges.

9. The apparatus of claim 1 in which said retainer member is in the shape of a cylinder.

10. The apparatus of claim 1 in which said retainer member is in the shape of a frustrum of a cone.

* * * * *